US007524089B2

(12) United States Patent
Park

(10) Patent No.: US 7,524,089 B2
(45) Date of Patent: Apr. 28, 2009

(54) LED LIGHT

(75) Inventor: Chang Sik Park, Chungcheongnam-do (KR)

(73) Assignee: Daejin DMP Co., Ltd., Cheonan-Si (KR)

( * ) Notice: Subject to any disclaimer, the term of this patent is extended or adjusted under 35 U.S.C. 154(b) by 98 days.

(21) Appl. No.: 11/048,888

(22) Filed: Feb. 3, 2005

(65) Prior Publication Data

US 2005/0174780 A1 Aug. 11, 2005

(30) Foreign Application Priority Data

Feb. 6, 2004 (KR) ..... 20-2004-0002947

(51) Int. Cl.
*F21V 29/00* (2006.01)

(52) U.S. Cl. ..... 362/294; 362/345; 362/373

(58) Field of Classification Search ..... 362/800, 362/545, 546, 547, 549, 294, 295, 300, 310, 362/311

See application file for complete search history.

(56) References Cited

U.S. PATENT DOCUMENTS 6,499,860 B2 * 12/2002 Begemann ..... 362/230
6,746,885 B2 * 6/2004 Cao ..... 438/26
6,787,999 B2 * 9/2004 Stimac et al. ..... 315/51
6,948,829 B2 * 9/2005 Verdes et al. ..... 362/227
6,982,518 B2 * 1/2006 Chou et al. ..... 313/46
7,144,135 B2 * 12/2006 Martin et al. ..... 362/294
7,144,140 B2 * 12/2006 Sun et al. ..... 362/373
2005/0128751 A1 * 6/2005 Roberge et al. ..... 362/276
2005/0254246 A1 * 11/2005 Huang ..... 362/362

* cited by examiner

*Primary Examiner*—Jacob Y Choi
(74) *Attorney, Agent, or Firm*—Birch, Stewart, Kolasch & Birch, LLP

(57) ABSTRACT

Disclosed herein is an LED light. The LED light comprises a socket electrically connected to a receptacle, and a cooling fan for forcibly circulating air. The cooling fan is received in a main body, which has a plurality of radial partition walls formed on the outer peripheral surface thereof in such a manner as to be spaced apart from one another with a gap having a slit shape for ventilation. A plurality of LEDs is attached to the outer periphery and/or the inner leading edge of the main body. A circuit board is provided to control the light such that an alternating current supplied from the socket is rectified into a direct current, which is supplied to the cooling fan and the LED.

7 Claims, 10 Drawing Sheets

LED LIGHT

BACKGROUND OF THE INVENTION

1. Field of the Invention

The present invention relates to an LED light , in which the illumination thereof can be significantly improved and the lifespan thereof can be extended, while functioning as illumination lighting such as an electric bulb or a lamp.

2. Background of the Related Art

An illumination light is a device, which is supplied with electric power and transforms the electrical energy into a light energy. The light energy is used for illuminating an object and discerning it in a dark place. This illuminating tool has made a great contribution to epochal advancement in human civilization. The illumination light is utilized in various forms. The initial incandescent bulb has developed into a fluorescent lamp, and then various electric lights have been developed, including a searchlight containing nitrogen or helium gas therein and a halide lamp or a natrium lamp.

However, there is a limitation in converting the electrical energy into a light energy, and thus a large amount of energy has been wasted. This has a close relationship with the efficiency of the electric lights or lamps. In addition, the lifespan thereof varies depending on the characteristics of the medium. Therefore, there is a need for a new medium having an advantage in terms of the efficiency of energy and the durability thereof.

In order to respond to this demand, a light emitting diode (LED) has been developed. The economical efficiency thereof still remains low due to its manufacturing cost. However, a high intensity of illumination can be obtained with a smaller amount of electric power and its lifespan reaches over three years without any particular repair, thereby providing a possibility and potentiality as a future illumination light.

As examples for a lighting apparatus using LED, Korean Patent Laid-open Publication No. 2003-0014951 discloses a incandescent bulb-type lamp using fluorescent LED lamp, and Korean Patent Laid-open Publication No. 2003-0008770 discloses a bulb having an LED module laminated therein.

An incandescent bulb-type lamp using fluorescent LED lamp, which is disclosed the above Korean Patent Laid-open Publication No. 2003-0014951, is shown in FIG. 9. An LED device for emitting light using DC voltage is provided, and a reflector is attached to the rear face of a light emitting portion. To the front face of the light emitting portion is attached a transmission lens for uniformly transmitting light. Therefore, the intensity of light can be controlled, depending on its application, and energy saving and semi-permanent lifespan can be achieved, along with protection of the user's visual power. In addition, it is an advanced bulb that is not affected by the temperature change of surroundings. However, after being used for a certain period of time, the LED efficiency deteriorates. Also, when it is continuously operated, the amount of heat generated is gradually increased, thereby reducing its lifespan In addition, as shown in FIG. 10, a bulb having a laminated LED module disclosed in the above Korean Patent Laid-open Publication No. 2003-0008770 comprises a socket 5 of common thread type, a bulb 40, a power supply 20 which is supplied with external electric power and supplies an electric current in the PWM mode, a multi-layered LED substrate 3 provided above the power supply 20 and having a plurality of basic LED modules in the form of a hexagon, and a connection pole for supplying the electric power to the multi-layered LED substrate 3 and holding it. Therefore, in order to obtain a high quality white light, a hexagon structure is used so as to arrange a maximum number of LEDs in a minimum space. An LED module, which is made of a red, green, and blue LEDs of the three primary colors of light, is formed and laminated in a multi-layered pattern, thereby providing a bulb having LED modules laminated therein and embedded with a power supply circuit. However, similarly, it embraces a problem in that the lifespan is reduced, due to heat generation.

SUMMARY OF THE INVENTION

Therefore, the present invention has been made in view of the above problems occurring in the prior art, and it is an object of the present invention to provide an LED light, in which a variety of applications can be achieved by providing a structure capable of being inserted into a receptacle and thus substituting for the electric bulbs and the halogen lamps, a high intensity of illumination can be achieved with a small amount of energy, an adequate intensity of illumination conforming to the user's desire can be obtained by modularizing LED and providing an appropriate spatial arrangement, and its lifespan can be maximized by providing an efficient cooling structure, while giving an adequate performance when continuously used.

To accomplish the above object, according to one embodiment of the present invention, there is provided an LED light. The LED light of the present invention includes a socket electrically connected to a receptacle, a cooling fan for forcibly circulating air, a main body for receiving the cooling fan and having a plurality of radial partition walls formed on the outer peripheral surface thereof in such a manner as to be spaced apart from one another with a gap having a slit shape for ventilation, a plurality of LEDs attached to the outer periphery and/or the leading edge of the main body, and a circuit board controlled such that an alternating current supplied from the socket is rectified into a direct current, which is supplied to the cooling fan and the LED.

In one embodiment of the invention, the radial partition walls are formed in the shape of a cylinder, a polyprism, or a conical body.

In another embodiment of the invention, the radial partition walls are air-communicated along only either the outer periphery or the inner leading end of the main body.

In another embodiment of the invention, the LED attached to the main body includes an LED pack, which is composed of plural sets of LEDs.

In another embodiment of the invention, the LED light further includes a transparent cap for enclosing the main body.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

The preferred embodiments of the invention will be hereafter described in detail, with reference to the accompanying drawings.

Figure 1:
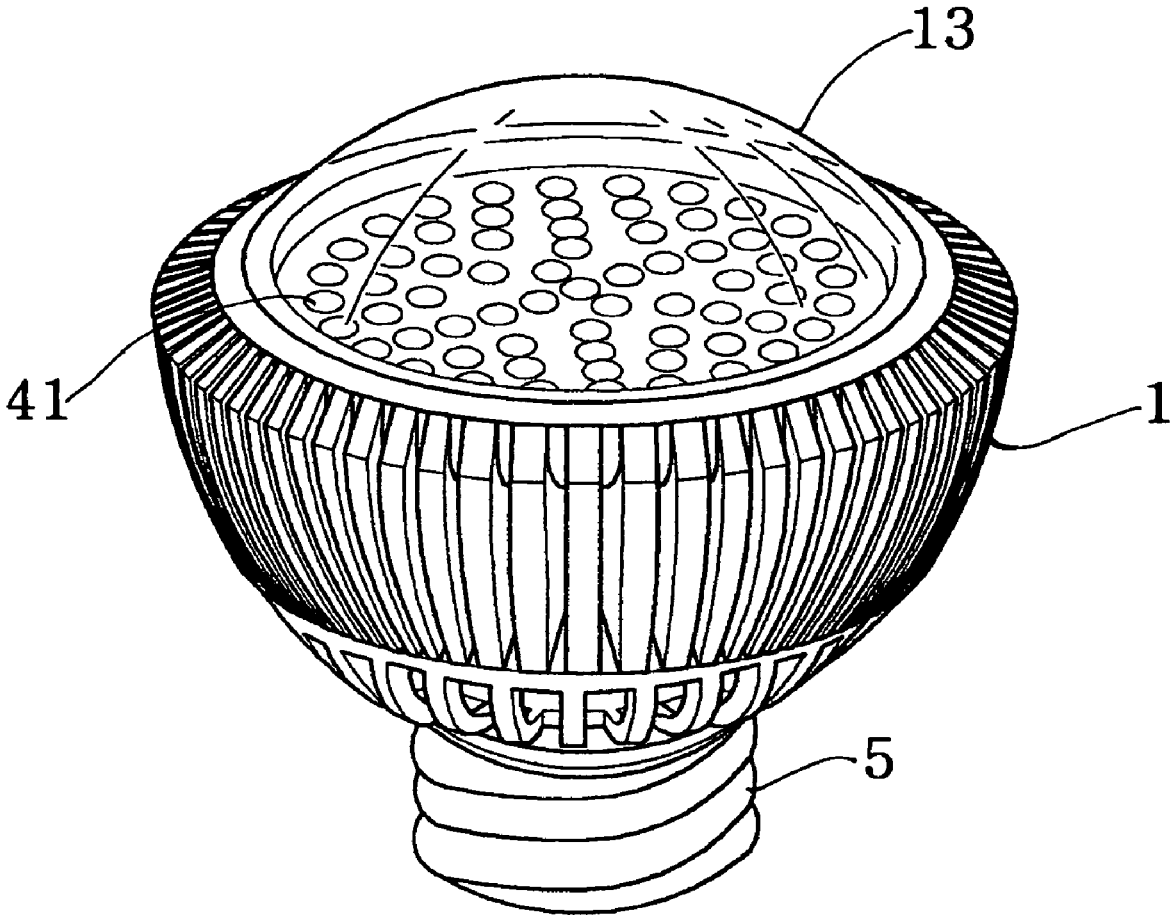
FIG. 1 is a perspective view of an LED light according to one embodiment of the invention.
Figure 2:
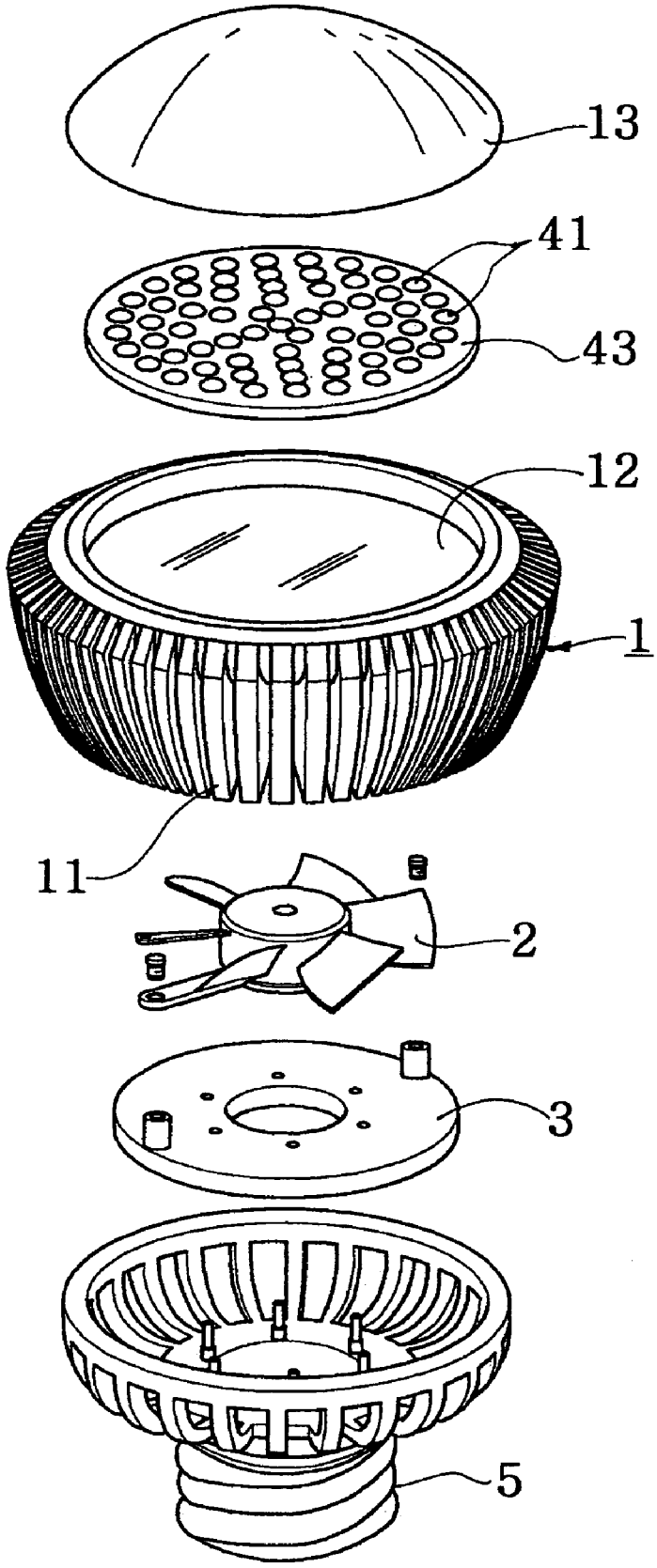
FIG. 2 is an exploded view of the LED light of FIG. 1.

FIG. 1 is a perspective view of an LED light according to one embodiment of the invention, and FIG. 2 is an exploded view of the LED light of FIG. 1.

As illustrated in FIGS. 1 and 2, there is shown the LED light of the invention including a socket 5 electrically connected to a receptacle, a cooling fan 2 for forcibly circulating air, and a main body 1 for receiving the cooling fan 2 and having a plurality of radial partition walls 11 for ventilation. A plurality of LEDs 41 is attached to the periphery and/or the leading edge of the main body 1. A circuit board 3 is provided so that an alternating current supplied from the socket 5 is rectified into a direct current, which is supplied to the cooling fan 2 and the LED 41.

Figure 7:
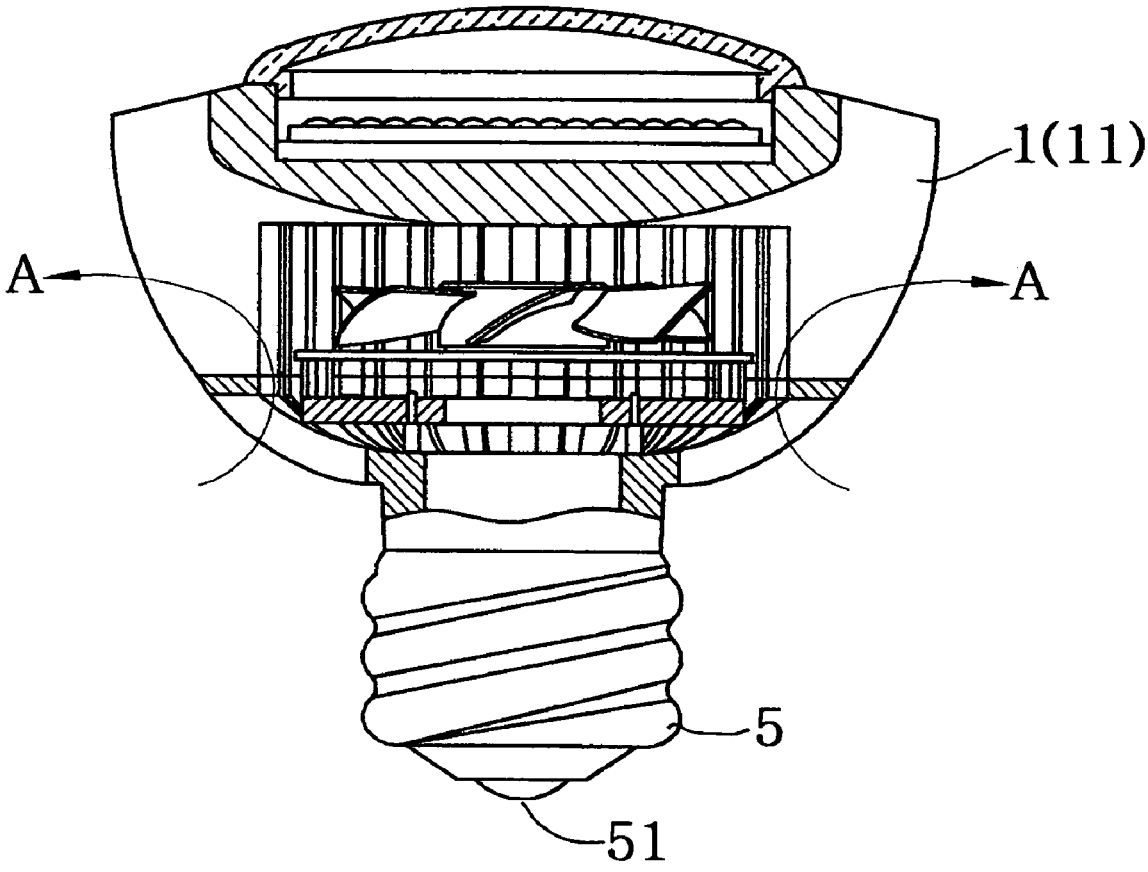
FIG. 7 is a cross-section showing the operational state of one embodiment of the invention.
Figure 8:
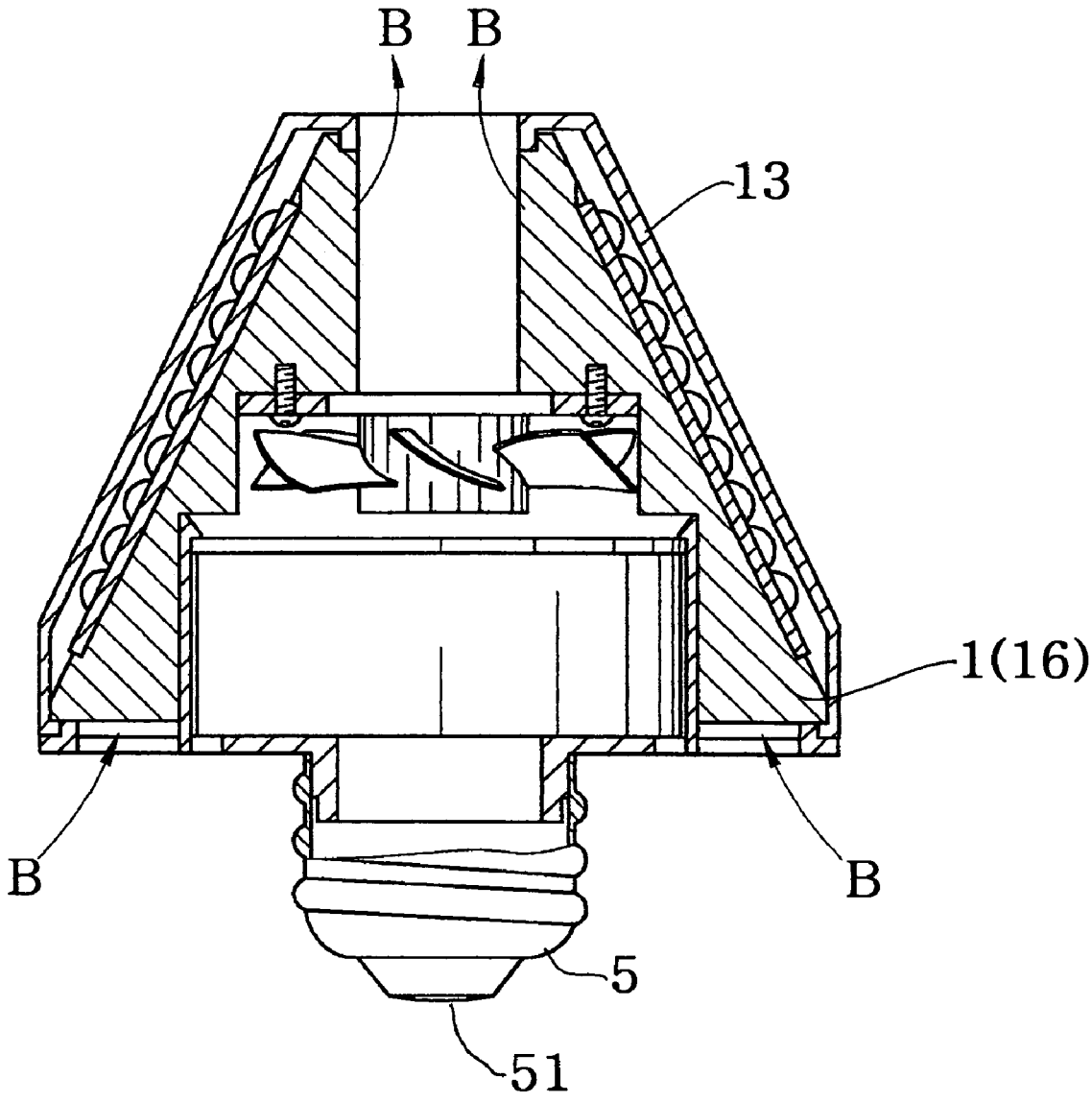
FIG. 8 is a cross-section illustrating the operational state of another embodiment of the invention.
Figure 9:
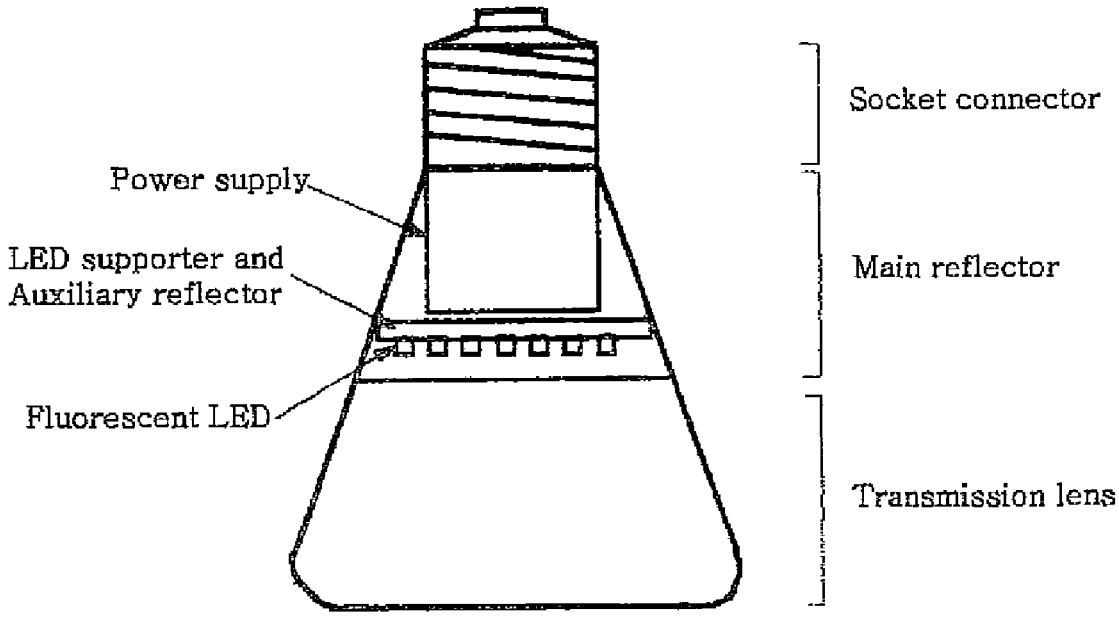
Prior Art FIG. 9
FIG. 9 is a plan view of a conventional light.
Figure 10:
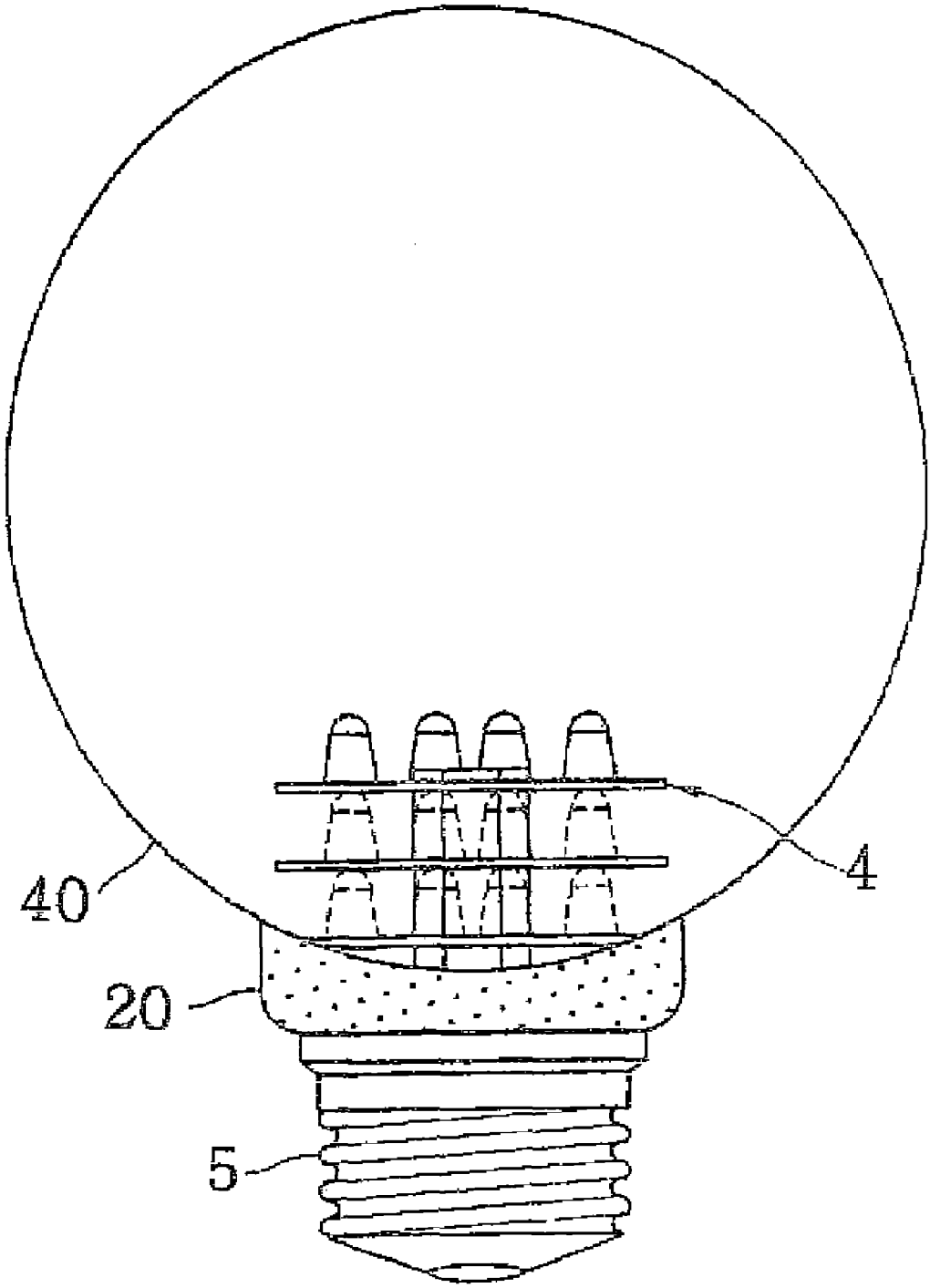
Prior Art FIG. 10
FIG. 10 is a plan view of another conventional light.

Referring to FIGS. 1 and 2, the socket 5 has a male thread formed thereon or a connector formed therein so that it can be electrically connected to a receptacle for an incandescent bulb having a female thread or a halogen lamp having a projection formed therein. In the center of the lower end of the socket 5 is formed a contact point 51. (FIGS. 7 and 8 illustrate a structure inserted into a receptacle.) The main body 1 is a three-dimensional structure having a desired shape and formed of a plurality of radial partition walls 11 for ventilation. The plurality of radial partition walls are spaced apart from one another with a gap having a slit shape. The partition walls are connected with each other by means of a connecting means such as a connecting rod (not illustrated) to thereby form a single element. Inside the main body 1, the cooling fan 2 and the circuit board 3 are accommodated in sequence. As illustrated in FIG. 2, the main body 1 has a ceiling 12 depressed inwards at an upper portion thereof, so that an LED board 43 with the plurality of LEDs 41 attached thereto is accommodated in the ceiling 12. (An LED socket 42 is embedded in the LED board 43)

In addition, the periphery of the main body is covered and protected by a cap 13. The cap 13 serves as an optical lens in front of the LED 41.

Therefore, the electric power input through the socket 5 is supplied to the circuit board 3, where the alternating current is rectified into a direct current. Depending on the required electric power, the rectified direct current is supplied to the cooling fan 2, and the LED 41 through the LED socket 42 or the LED board 43 functioning in the same way as the LED socket 42. Resultantly, the plurality of LEDs 41 emits light. At this time, part of the generated heat is removed in such a manner that the main body 1 is cooled by air passing the partition walls 11 thereof by means of the cooling fan 2. Therefore, the main body 1 serves as a heat sink, and thus the LED 42 attached to the main body 1 is cooled through heat-conduction. Accordingly, the main body 1 is preferred to be formed of a metallic material having a high heat equivalent. Furthermore, the light emitted from the plurality of LEDs 41 can be adjusted appropriately depending on the applications. For example, the emitted light can be convergent or divergent through the cap 13.

Figure 3:
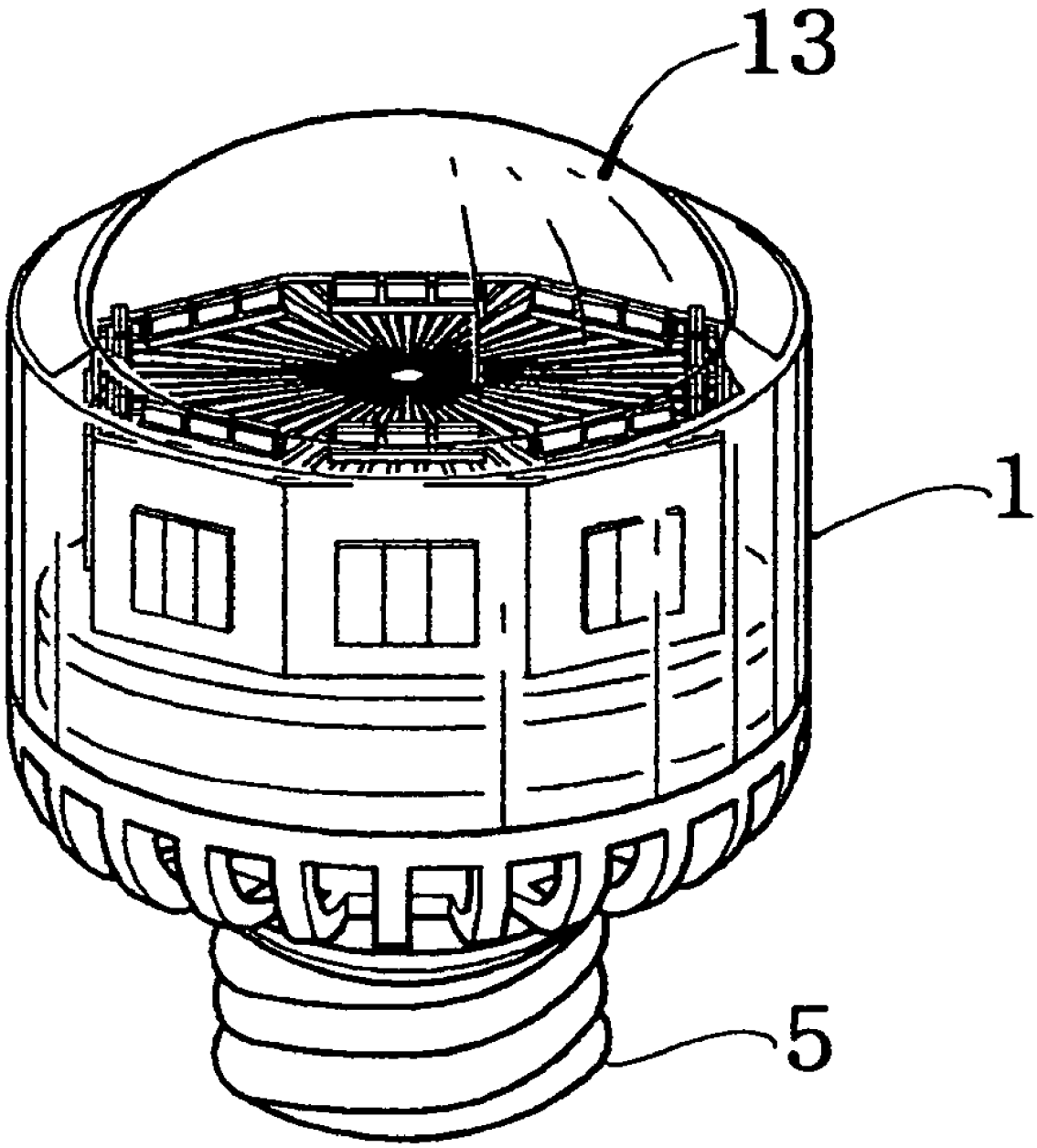
FIG. 3 is a perspective view of an LED light according to another embodiment of the invention.
Figure 4:
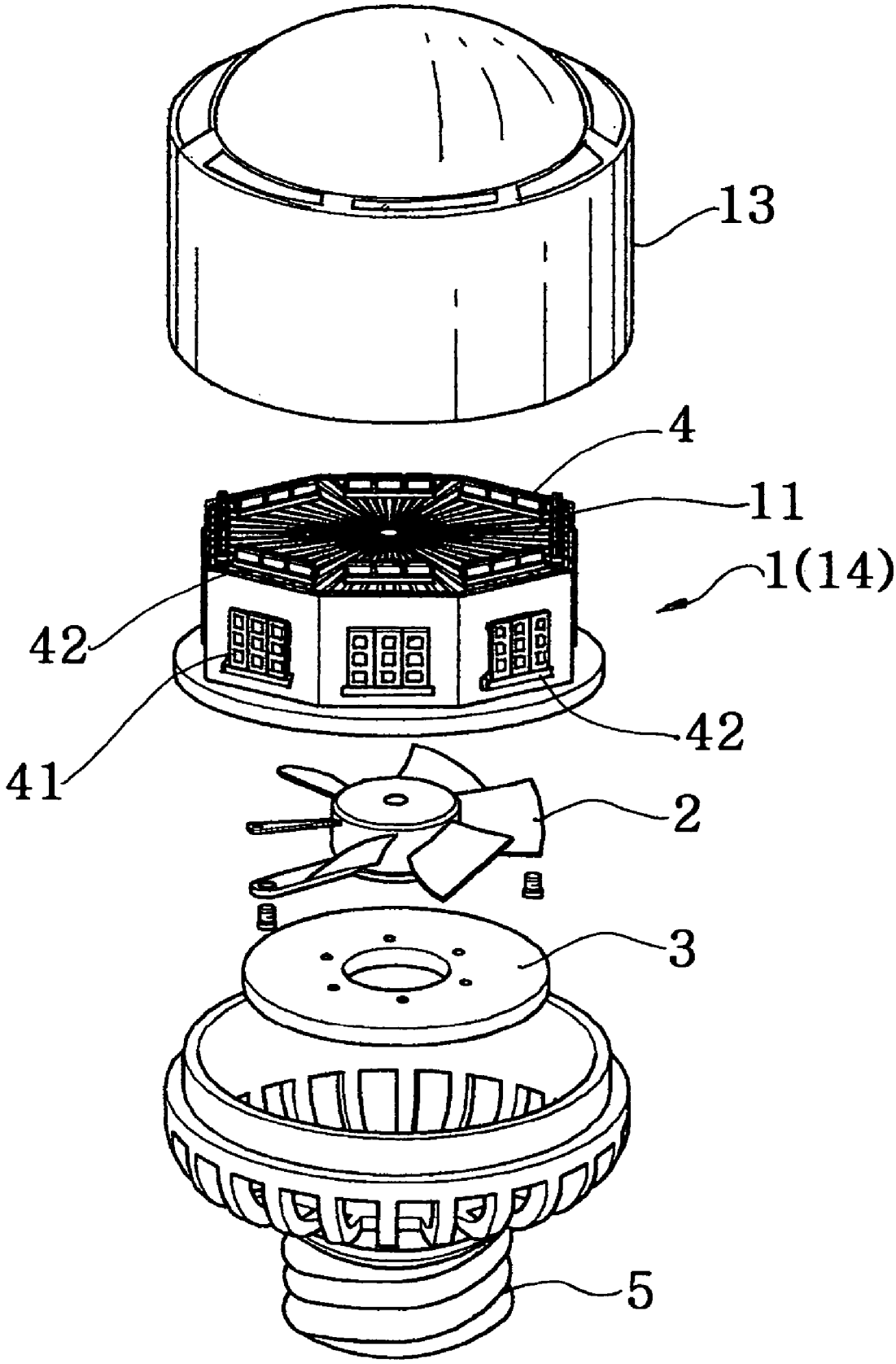
FIG. 4 is an exploded view of the LED light of FIG. 3.

FIG. 3 is a perspective view of an LED light according to another embodiment of the invention, and FIG. 4 is an exploded view of the LED light of FIG. 3.

The same elements as in the previous embodiment are denoted by the same reference numerals, and details thereon will not be repeated.

In the previous embodiment, the main body 1 is formed in the shape of a cylinder. In contrast, this embodiment is constituted in the same way as in the above embodiment, except that the main body 1 is formed in the shape of a polyprism 14, and the LED 41 is disposed in the front face and also the lateral face of the polyprism 14, as illustrated in FIGS. 3 and 4. In addition, this embodiment is structured in such a way that the partition walls 11 are blocked and thus the outer peripheral side wall of the main body 1 is not ventilated. However, since air flows towards the inner leading end of the main body 1, the LED 41 or the LED pack 4 is forcibly cooled directly by the air. The LED 41 or the LED pack 4 tightly attached to the lateral face of the main body by means of an adhesive such as a metal bond can be appropriately cooled through heat-conduction. Therefore, when the power is supplied, they can radiate light forwards and sideways, while being properly cooled.

Figure 5:
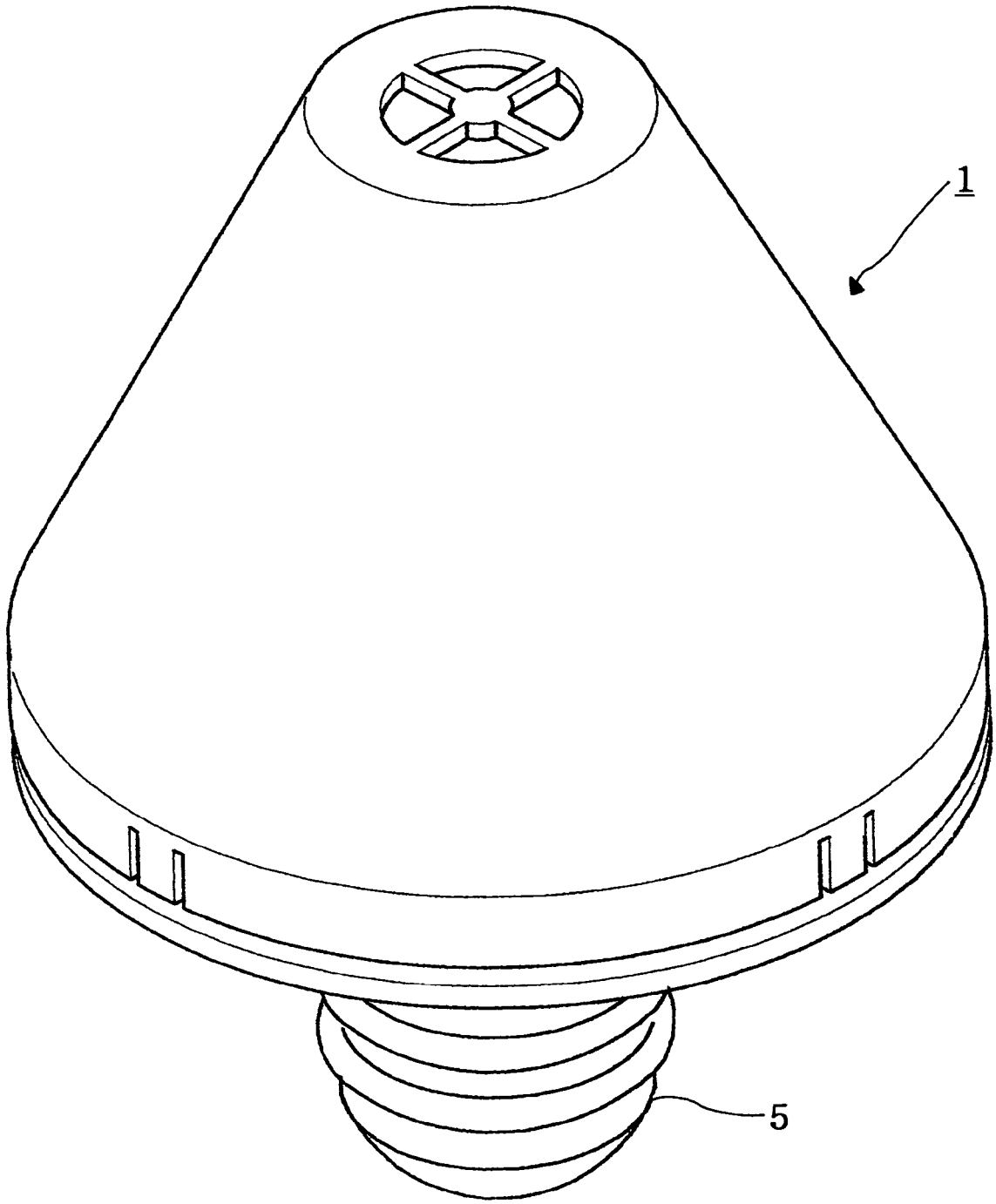
FIG. 5 is a perspective view of an LED light according to a further embodiment of the invention.
Figure 6:
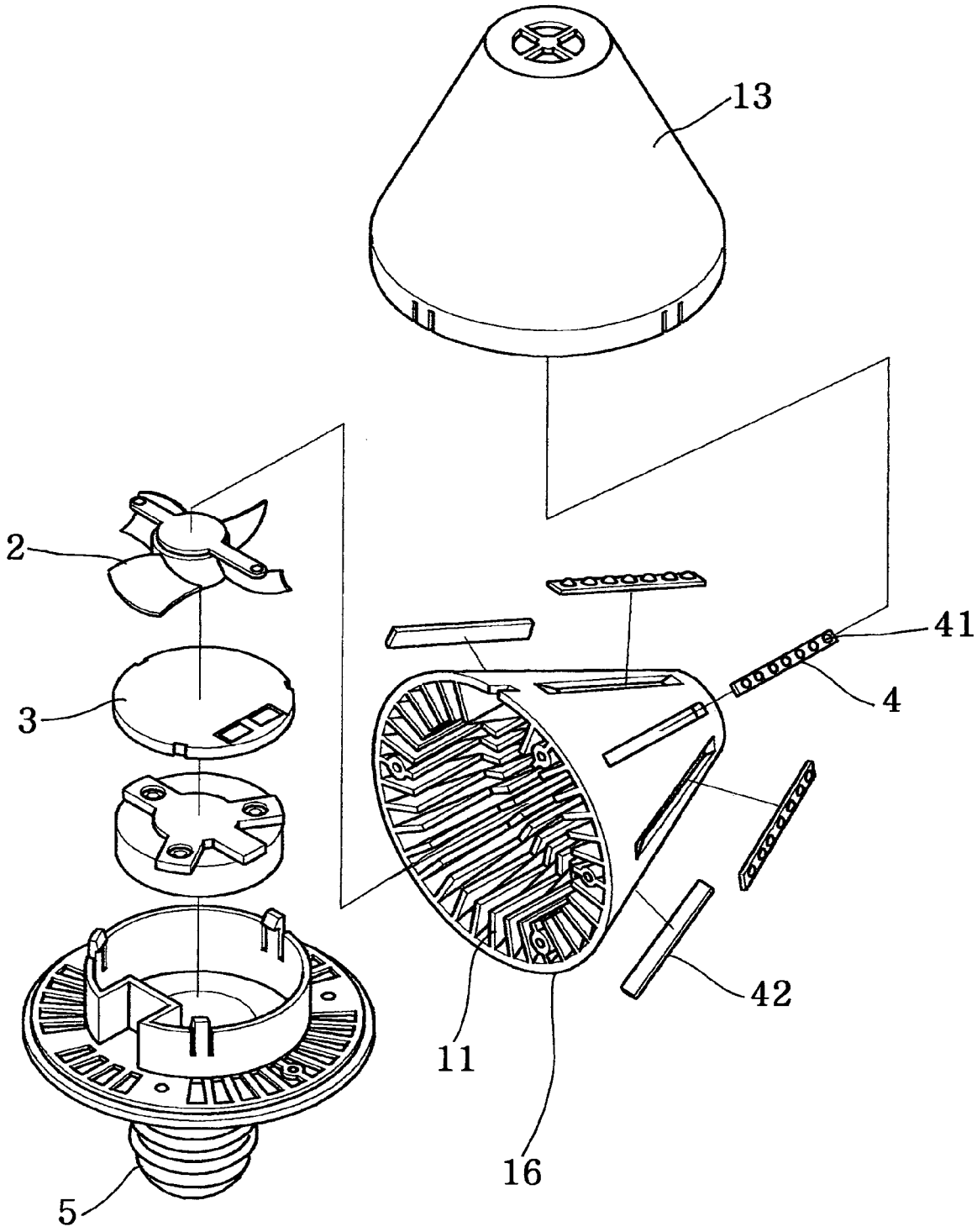
FIG. 6 is an exploded view of the LED light of FIG. 5.

FIG. 5 is a perspective view of an LED light according to a further embodiment of the invention, and FIG. 6 is an exploded view of the LED light of FIG. 5.

Referring to FIGS. 5 and 6, the main body 1 is constituted of a conical body 16 having a cone shape, and the LED 41 or the LED pack 4 is attached to the side wall at diagonal positions. Other elements are the same as in the previous embodiments.

Therefore, when the power is supplied, as shown in FIG. 8, air is properly circulated along the arrow B and simultaneously light is radiated from the side face in an inclined direction.

Furthermore, the main body 1 is formed of a conical body 16, and thus the outer peripheral area thereof is maximized to thereby expand the area for the LED 41 or the LED pack 4 to be attached and provide a freedom of LED disposition. The partition walls 11 are disposed in a radial direction and air is forcibly circulated between the partition walls. The cooling fan 2 and the partition walls 11 are configured such that air passing between the partition walls 11 is accelerated to thereby absorb the heat of the partition walls 11 adequately.

In addition, The LED 41 is preferred to be the LED pack 4, which is composed of plural sets. This is because the LED pack 4 can be conveniently attached, as compared with a separate attachment of each individual LED 41, so that the process can be simplified, thereby enabling mass production and reduced manufacturing cost.

The present invention, in general, comprises the socket 5, the circuit board 3, a cooling fan 2, a conical body 1, and the LED 41 or LED pack 4, each of which is formed in a unit, thereby enabling mass production and convenient assembling. The operation of each component will be hereafter described.

First, the socket 5 is electrically connected to a receptacle for an incandescent bulb, a lamp having or the like, and therefore, the LED light of the invention can replace the incandescent bulb or the halogen lamp. The circuit board 3 is controlled such that the alternating current is rectified into a direct current, transformed into an appropriate electric power, and supplied. In this way, the supplied power drives the plurality of LEDs 41 and the cooling fan 2. However, the cooling fan 2 may be driven by an A.C. motor instead of the D.C. motor, and in this case the electric power is supplied directly to the cooling fan, without passing through the circuit board 3.

In addition, the cooling fan 2 circulates forcibly the air between the partition walls 11 while cooling the main body 1, so that the LED 41 or the LED pack 4 can be cooled. Therefore, the LED 41 can emit light in an optimum condition.

As described above, according to the present invention, a variety of applications can be achieved by providing a structure capable of being inserted into a receptacle and thus substituting for the electric bulbs and the halogen lamps. A high intensity of illumination can be achieved with a small amount of energy. An appropriate intensity of illumination conforming to the user's desire can be obtained by modularizing LED and providing an appropriate spatial arrangement. In particular, the lifespan thereof can be maximized by providing an efficient cooling structure, while giving an adequate performance when continuously used.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An LED light comprising:

a socket for electrical connection with a receptacle;

a cooling fan including fan blades for forcibly circulating air;

a main body receiving said cooling fan, said main body being generally cylindrical and ring-shaped, said main body having a plurality of radial partition walls which receive the circulating air therebetween for cooling said main body, said main body having a ceiling extending across an upper portion which is depressed inwardly to form a depression which is closer to the upper portion of said main body than to said socket;

a plurality of LEDs received in said depression and provided on said ceiling, said ceiling being located between said LEDs and said cooling fan;

a lens located at a periphery of said main body and covering said plurality of LEDs; and a circuit board controlled such that an alternating current supplied from said socket is rectified into a direct current, which is supplied to said cooling fan and said LEDs, said circuit board being located beneath said fan with said fan blades received within said main body, wherein said cooling fan is provided inside said main body to blow the air towards said ceiling, and wherein said radial partition walls are provided on a side of said main body and include gaps in said radial partition walls to discharge the blown air towards the side of said main body.

2. The LED light according to claim 1, wherein said radial partition walls are air-communicated along only the outer periphery.

3. An LED light comprising:

a socket for electrical connection with a receptacle;

a cooling fan including fan blades for forcibly circulating air;

a main body receiving said cooling fan, said main body being generally conical, said main body having a plurality of radial partition walls for ventilation which receive the circulating air therebetween for cooling said main body, said radial partition walls being bounded by at least one circumferential wall surrounding a side of said cooling fan;

a plurality of LEDs attached to an outer surface of said circumferential wall;

a lens located at a periphery of said main body and covering said plurality of LEDs; and a circuit board controlled such that an alternating current supplied from said socket is rectified into a direct current, which is supplied to said cooling fan and said LEDs, said circuit board being located beneath said fan with said fan blades received within said main body, wherein said LEDs include an LED pack, which includes plural sets of LEDs, and wherein said cooling fan is provided inside said main body to blow the air towards said lens.

4. The LED light according to claim 1, wherein the gaps have a slit shape.

5. The LED light according to claim 1, wherein each of said radial partition walls have a main surface extending parallel to a radius of said main body.

6. The LED light according to claim 1 or 3, wherein said lens is transparent.

7. The LED light according to claim 3, wherein said radial partition walls are air-communicated along only the leading end of said main body.

* * * * *